US008177143B2

(12) United States Patent
Laible

(10) Patent No.: US 8,177,143 B2
(45) Date of Patent: May 15, 2012

(54) HAND-HELD DISPENSER

(76) Inventor: Rodney Laible, Omaha, NE (US)

( * ) Notice: Subject to any disclaimer, the term of this patent is extended or adjusted under 35 U.S.C. 154(b) by 430 days.

(21) Appl. No.: 12/378,858

(22) Filed: Feb. 20, 2009

(65) Prior Publication Data

US 2010/0213280 A1 Aug. 26, 2010

(51) Int. Cl.
*B05B 7/30* (2006.01)

(52) U.S. Cl. ..... 239/318; 239/310; 239/340; 239/407; 239/413; 239/434; 239/581.1

(58) Field of Classification Search ..... 239/9, 310, 239/318, 340, 354, 375, 407, 413, 433, 434, 239/525, 526, 281.1, 583; 251/206, 207
See application file for complete search history.

(56) References Cited

U.S. PATENT DOCUMENTS

| | | | | |
|---|---|---|---|---|
| 2,388,445 | A * | 11/1945 | Stewart | 239/318 |
| 6,988,675 | B2 | 1/2006 | Hubmann | |
| 7,237,728 | B1 | 7/2007 | Laible | |
| 7,296,761 | B1 | 11/2007 | Laible | |
| 2006/0131335 | A1 * | 6/2006 | Hubmann | 222/145.1 |
| 2007/0267519 | A1 * | 11/2007 | Laible | 239/310 |

* cited by examiner

*Primary Examiner* — Jason Boeckmann
(74) *Attorney, Agent, or Firm* — Dennis L. Thomte; Thomte Patent Law Office LLC

(57) ABSTRACT

A hand-held dispenser for precisely controlling the flow rate of water therethrough and for precisely injecting a liquid chemical into the water passing through the apparatus. The dispenser is also capable of dispensing a water-only rinse spray.

6 Claims, 5 Drawing Sheets

HAND-HELD DISPENSER

BACKGROUND OF THE INVENTION

1. Field of the Invention

This invention relates to a hand-held dispenser and more particularly to a hand-held dispenser which is convenient to use and which is capable of controlling the flow rate of water therethrough for mixing with a liquid chemical into the water passing through the dispenser. Further, this invention relates to a hand-held dispenser which is capable of mixing precise amounts of liquid chemical into the water flowing through the dispenser. Even further, this invention relates to a hand-held dispenser including means for blocking the flow of liquid chemical into the water so that a water-only rinse spray is obtained.

2. Description of the Related Art

Many types of dispensers have been previously provided which may be connected to the end of a water hose or the like wherein the device introduces chemicals into the water flow so that a lawn or the like may be sprayed. The devices of the prior art are also able to inject liquid chemicals into a water stream so that a mop bucket, etc., may be filled with water, detergent or other chemicals.

In Applicant's earlier U.S. Pat. Nos. 7,237,728 and 7,296,761, hand-held dispensers are disclosed which are able to conveniently and economically precisely control the rate of water flow through the dispenser and to precisely control the metering of liquid chemicals in the precisely controlled flow of water.

Although the dispensers of Applicant's earlier patents have met with considerable success, Applicant has developed an improved hand-held dispenser which is convenient to use which precisely controls the water flow therethrough and which precisely controls the injection of liquid chemicals thereinto.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A hand-held dispenser is described for precisely and conveniently controlling the flow rate of water therethrough so that a liquid chemical or the like may be mixed in a precisely controlled amount with the water passing therethrough and so that the flow of liquid chemical into the water may be blocked to provide a water-only rinse spray. The apparatus of this invention comprises a body member which includes a generally horizontally disposed first body portion having first and second sides, an inlet end and a discharge end. The body member also includes a generally vertically disposed second body portion extending downwardly from the first body portion, with the second body portion having a lower end adapted to be secured to a liquid container. The first body portion has a generally horizontally disposed first body member which extends inwardly from the inlet end of the body member towards the discharge end thereof. The first body member has an inlet end and a discharge end and has a horizontally disposed first passageway formed therein which extends from the inlet end towards the discharge end thereof, with the first passageway having an inlet end and a discharge end. The inlet end of the first passageway is adapted to be placed in communication with a source of water under pressure.

The first body portion also has a generally vertically disposed second body member positioned at the discharge end of the first body member with the second body member having upper and lower ends. The second body member has a cylindrical chamber formed therein which has an inlet end and a discharge end. The second body member has an annular valve seat formed therein above its inlet end with the valve seat having an inlet side and a discharge side. The inlet side of the valve seat is in communication with the first passageway with the discharge side of the valve seat being in communication with the cylindrical chamber in the second body member. A vertically movable first valve means is selectively vertically movably mounted in the chamber with the first valve means including a valve member positioned below the valve seat and a valve stem secured to the valve member which extends upwardly therefrom through the valve seat and through a valve guide positioned in the chamber. The first valve means is selectively vertically movable between a lower position to an upper position. The valve member of the first valve means closes the valve seat when the first valve means is in its upper position. The valve member, when the first valve means is in its lower position, permits the flow of water from the first passageway, through the valve seat, and upwardly into the valve guide in the chamber.

A valve actuating lever is pivotally secured to the first body portion which is operatively connected to the upper end of the valve stem. The lever is pivotally movable from an upper "off" position wherein the first valve means is in its upper position to a lower "on" position wherein the first valve means is unseated from the valve seat.

The first body portion also has a horizontally disposed second passageway formed therein which extends from the valve guide in the chamber, above the valve seat towards the discharge end of the first body portion. The first body portion also has a third body member positioned at the downstream side of the second body member. The third body member has a transversely extending spool opening formed therein. The third body portion also has a third passageway formed therein which extends from the spool opening to the second passageway. The third body portion has a fourth passageway extending from the spool opening towards the discharge end of the first body portion. The third and fourth passageways are in alignment with each other. A spool valve is selectively rotatably mounted in the spool opening with the spool valve having at least two passageways formed therein which have different diameters. The spool valve is selectively rotatably so that either of the two passageways therein may be placed in communication with the third and fourth passageways. The first body portion has an elongated fifth passageway extending from the spool opening to the discharge end of the first body portion. The first body portion also has a sixth passageway formed therein which extends downwardly from the fifth passageway to the lower end of the second body portion so as to be in communication with the liquid in the liquid container. A three-position spool valve is provided in the second body portion which is imposed in the sixth passageway. Two different metering orifices are formed in the three-position spool valve to allow two different amounts of liquid chemical to be injected into the water which may discharge from the dispenser at two different rates. The spool valve in the second body portion may also be rotated to a third position wherein the flow of liquid chemical from the container may be blocked to provide a water-only rinse spray. The passage of water through the fifth passageway to the discharge end of the first body portion, when the first valve means is in its open position, draws liquid from the liquid container upwardly through the sixth passageway by way of the rotatable spool valve imposed therein for mixing with the water passing through the fifth passageway.

When the first valve means is in its closed position, the water pressure below the valve member yieldably urges the spring-loaded valve means to its upper closed position. When the first valve means is in its open position, the water pressure above the valve member yieldably maintains the first valve means in its lower open position. The water flow rate through the dispenser may be controlled by rotating the spool valve to its desired position.

It is therefore a principal object of the invention to provide an improved hand-held dispenser.

A further object of the invention is to provide an improved chemical dispenser.

Still another object of the invention is to provide an improved hand-held dispenser which dispenses chemicals mixed with water.

Still another object of the invention is to provide a dispenser of the type described which enables the precise control rate of the flow rate of water therethrough.

Yet another object of the invention is to provide a hand-held dispenser of the type described which is capable of a water-only rinse spray.

Still another object of the invention is to provide a dispenser which is economical of manufacture, durable in use and refined in appearance.

Still another object of the invention is to provide a hand-held dispenser including means for controlling the water flow rate and chemical flow rate.

These and other objects will be obvious to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DETAILED DESCRIPTION OF THE INVENTION

Figure 1:
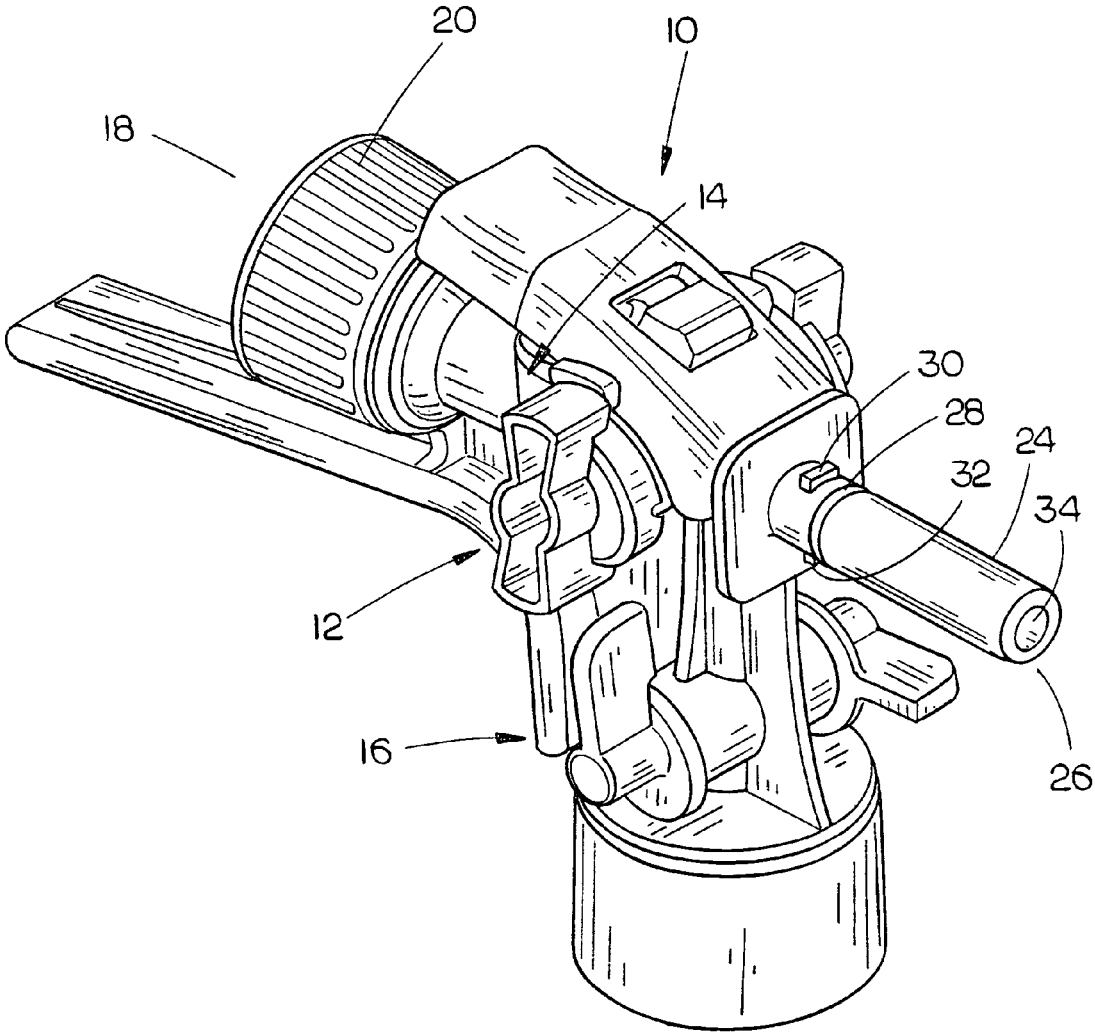
FIG. 1 is a perspective view of the hand-held dispenser of this invention.
Figure 2:
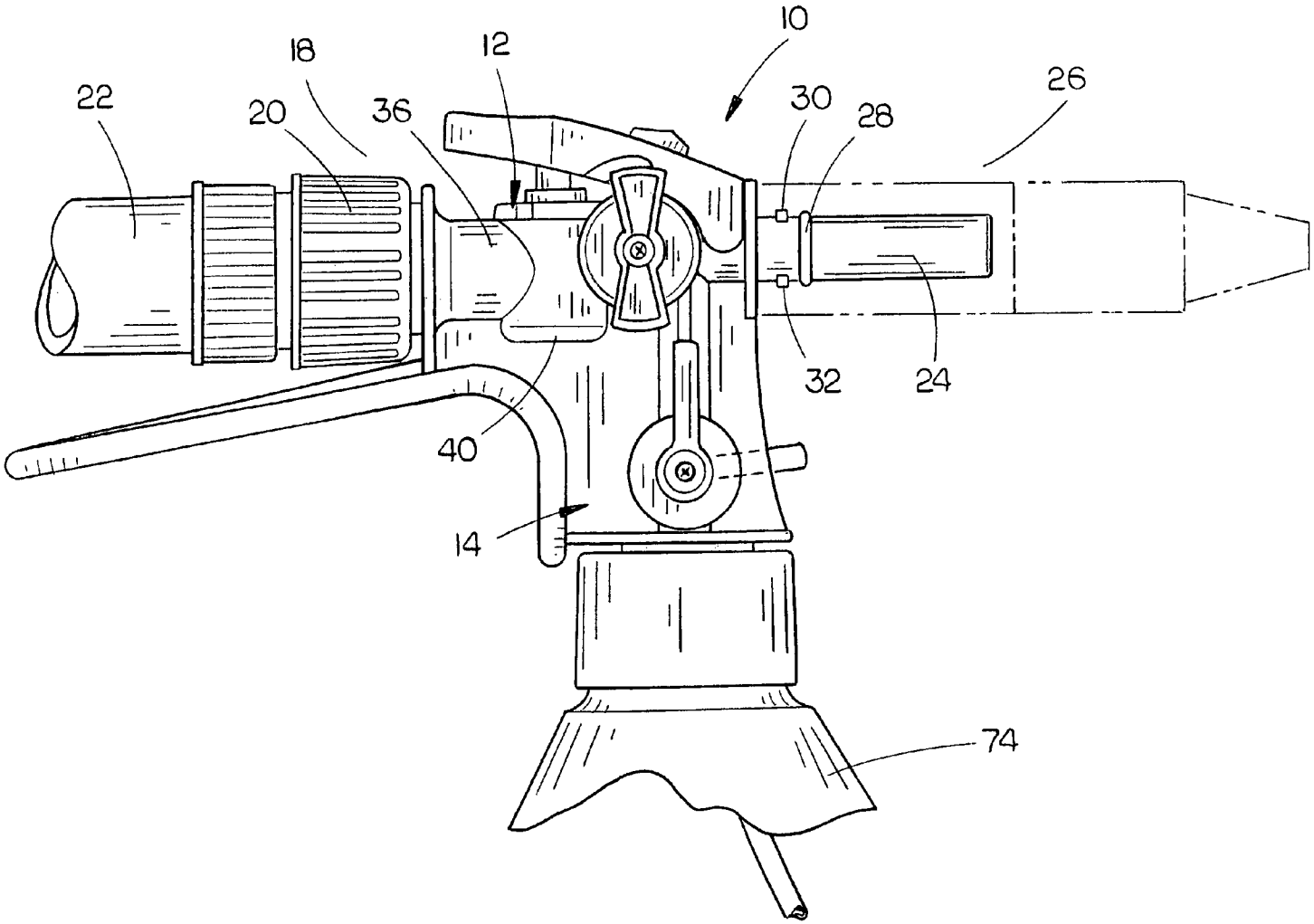
FIG. 2 is a side view of the hand-held dispenser of this invention.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The hand-held dispenser of this invention is referred to generally by the reference numeral 10 and includes a dispenser body 12 which is generally T-shaped in configuration and which includes a generally horizontally disposed body portion 14 and a generally vertically disposed body portion 16. Obviously, body portion 14 will not always be horizontally disposed when being used nor will body portion 16 always be substantially vertically disposed when in use.

Figure 3:
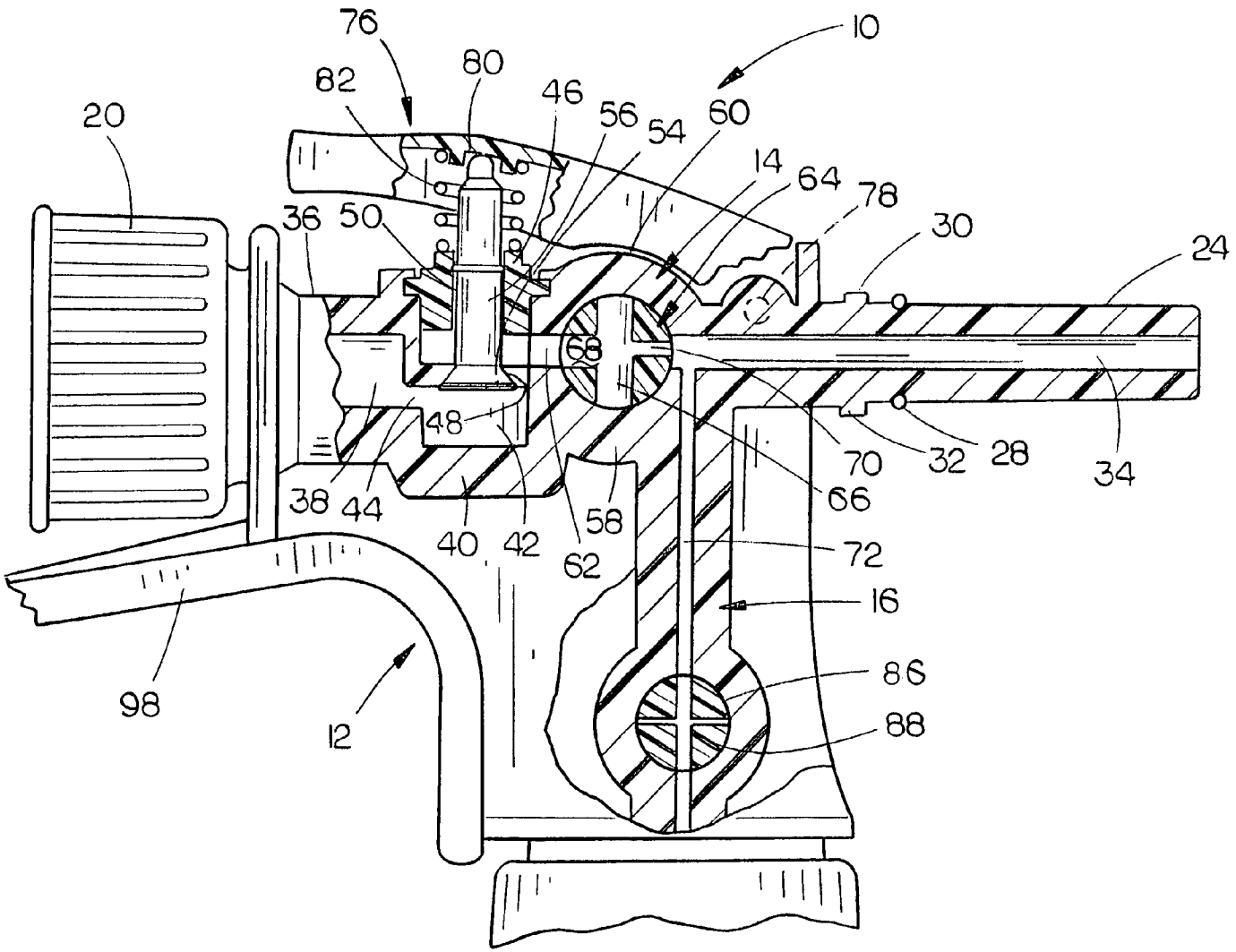
FIG. 3 is a partial sectional view of the hand-held dispenser of this invention.
Figure 4:
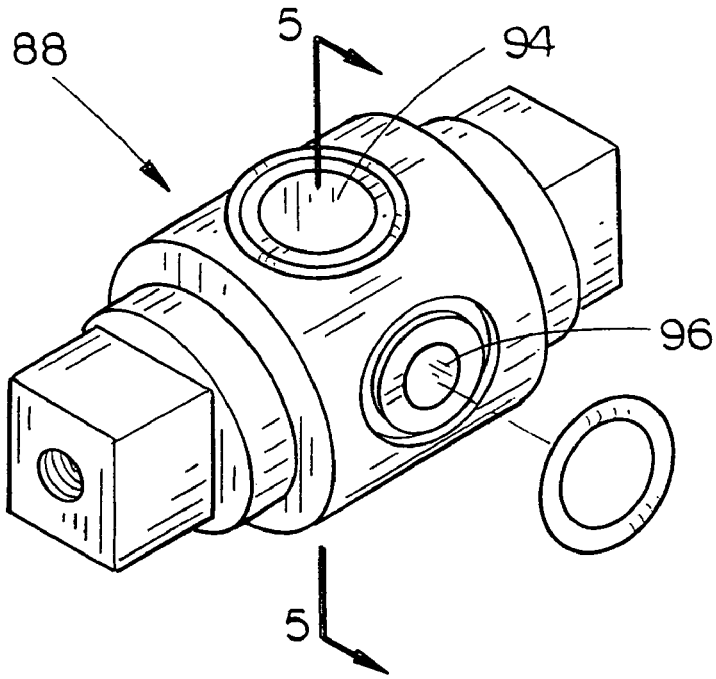
FIG. 4 is a perspective view of the chemical injection spool valve of this invention.
Figure 5:
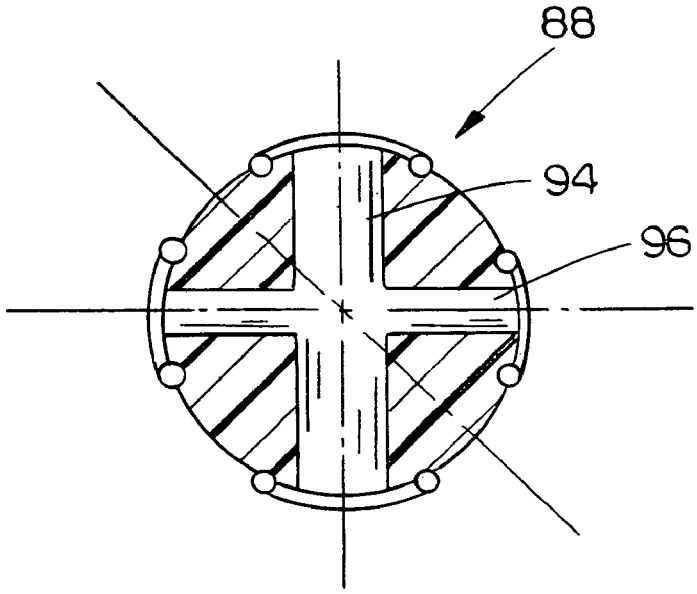
FIG. 5 is a sectional view as seen on lines 5-5 of FIG. 4.
Figure 6:
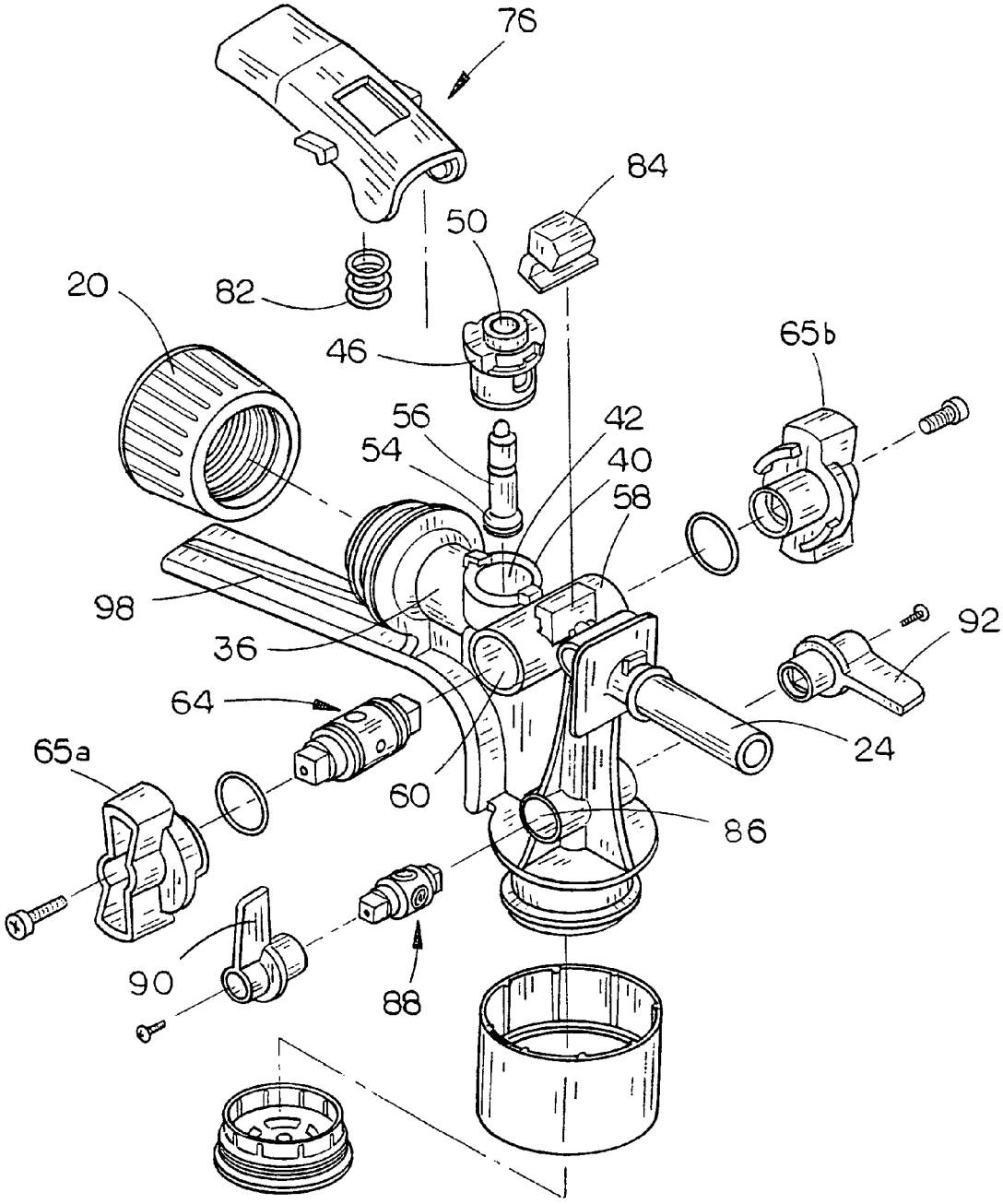
FIG. 6 is an exploded perspective view of the hand-held dispenser of this invention.

Body portion 14 includes an inlet end 18 which preferably has a rotatable dispenser nut or connector 20 mounted thereon so that a water hose or the like may be secured thereto with the water hose being in communication with a source of water under pressure. It is preferred that a back flow preventer of conventional design be imposed between the water hose 22 and the connector 20. An elongated hollow discharge tube 24 is provided at the discharge end 26 of the body portion 14. As will be explained hereinafter, tube 24 may have any type of discharge nozzle selectively removably mounted thereon. A seal ring 28 is mounted on tube 26 as seen in FIG. 1. A pair of oppositely disposed locking lugs 30 and 32 project from tube 26 adjacent the inner end thereof as seen in FIG. 3. Tube 26 has a bore or passageway 34 extending therethrough.

Body portion 14 includes a horizontally disposed cylindrical body member 36 at its inlet 18 which has a bore or passageway 38 (FIG. 3) extending therethrough. The inner end of body member 36 joins a vertically disposed hollow cylindrical body member 40 having a vertically disposed cylindrical chamber or passageway 42 formed therein. The inner end of bore 38 of body member 36 communicates with a small opening 44 formed in the side wall of body member 40 so that water may flow through passageway 38, through opening 44 and into chamber 42 above the lower end of body member 40. A generally cylindrical valve guide or insert 46 is selectively removably positioned in chamber 42 above the lower end thereof. Valve guide 46 has an annular valve seat 48 formed therein at the lower end thereof which communicates with bore 50 formed in valve guide 46.

The numeral 54 refers to a valve which is designed to seat upon valve seat 48 to close the same. Valve stem 56 extends upwardly from valve 54 and vertically movably extends upwardly through passageway or bore 50 so that the upper end of valve stem 56 is positioned above valve guide 46.

Body portion 14 also includes a transversely extending cylindrical member 58 having a chamber 60 formed therein, with the chamber 60 communicating with chamber 42 by way of passageway 62 and with passageway 34 in discharge tube 24. An elongated, cylindrical spool valve 64 is selectively rotatably mounted in chamber 60 and includes opposite ends. Handles or knobs 65*a* and 65*b* are secured to the opposite ends of spool valve 64 respectively to permit the selective rotation of spool valve 64. Spool valve 64 has a first passageway or bore 66 extending therethrough. Spool 64 also has a second passageway or bore 68 formed therein which communicates with bore 66. Spool 64 also has a bore or passageway 70 which is aligned with bore 68 and which communicates with passageway 66. As seen, bores 66 and 68 have the same diameter with bore 70 having a smaller diameter than bores 66 and 68.

Spool valve 64 may be selectively rotated so that passageway 68 communicates with passageway 62 and so that bore 70 communicates with passageway 34 in tube 26. Spool 64 may also be selectively rotated so that the ends of bore 66 communicate with passageways 62 and 34 to change the flow rate of the dispenser. Other types of spool valves having various sized bores formed therein may be utilized to vary the flow rate of the dispenser as required. Bore 72 is formed in body portion 16 with its lower end communicating with the interior of a container 74 containing liquid chemicals or the like. As water flows past the upper end of passageway 72, a venturi action is created to draw or suck the liquid from the container 74 into the passageway 34 where it is mixed with the water flowing through passageway 34 and then discharged from tube 34.

The numeral 76 refers to an actuating lever having its forward end pivotally secured to body portion 14 at 78. The underside of lever 76 is connected to the upper end of valve stem 56 at 80 so that pivotal movement of lever 76 will cause valve stem 56 to be vertically moved in response to movement of the lever 76. Spring 82 embraces the upper end of valve stem 56 between the underside of lever 76 and the upper end of valve guide 46 to yieldably maintain the rearward end of lever 76 in its upper "off" position and to maintain valve 54 in seating engagement with valve seat 48 thereby preventing flow of water through the dispenser 10. As the rearward end of the lever is depressed from its upper "off" position, valve stem 56 will be moved downwardly in bore 50 to unseat valve 54 from valve seat 48 so that water will flow through passageway 38, opening 44, into chamber 42 upwardly through valve seat 48, upwardly into passageway 50, through the forward end of passageway 52, through passageway 62, through the selected passageways in spool 64, into passageway 34 and outwardly from tube 26. Dispenser 10 also includes a slide lock 84 which is movably mounted thereon to permit the selective locking of the lever 76 in either its "off" position or its "on" position.

When valve 54 is in its closed position, the pressure of the water therebelow in chamber 42 is exerted upwardly onto the lower end of valve 54 to aid in maintaining the valve 54 in its closed position. When valve 54 is moved downwardly from its closed position, the water pressure against the upper side of the valve 54 aids in maintaining the valve 54 in its open position. Various types of discharge nozzles may be selectively mounted on the discharge tube 24.

The body portion 16 has a horizontally disposed chamber 86 extending between the sides thereof and which intersects passageway 72. A three-position spool valve 88 is rotatably mounted in chamber 86 and has a lever, knob or handle mounted at each end thereof, identified by the reference numerals 90 and 92. Spool valve 88 has a first passageway or metering orifice 94 extending transversely therethrough and has a second passageway or metering orifice 96 extending transversely therethrough. As seen, orifice 94 has a larger diameter than orifice 96. Either of the orifices 94 or 96 may be placed in fluid communication with passageway 72 by rotating spool valve 88 so that precise amounts of liquid chemical may pass therethrough for injection into the water passing through passageway 34. Further, and very importantly, the spool valve 88 may be selectively rotated to a third position wherein neither orifices 94 nor 96 communicate with passageway 72. In this position, only water will pass from the discharge end of the dispenser to provide a water-only spray rinse.

For convenience, dispenser 10 is provided with a handle 98 which may be grasped by the user of the dispenser or which may be clipped onto a water bucket or the like.

Thus, it can be seen that a dispenser has been provided which accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

The invention claimed is:

1. A hand-held dispenser apparatus for controlling the flow rate of water therethrough and for injecting a liquid chemical into the water passing through the apparatus, comprising:

a body member;

said body member including a generally horizontally disposed first body portion having first and second sides, an inlet end, and a discharge end;

said body member also including a generally vertically disposed second body portion, having opposite sides, extending downwardly from said first body portion;

said second body portion having a lower end adapted to be secured to a liquid container;

said first body portion having a generally horizontally disposed first body member which extends inwardly from said inlet end of said body member toward said discharge end thereof;

said first body member having an inlet end and a discharge end;

said first body member having a horizontally disposed first passageway formed therein which extends from said inlet end towards said discharge end thereof;

said first passageway having an inlet end and a discharge end;

said inlet end of said first fluid passageway adapted to be placed in communication with a source of water under pressure;

said first body portion having a generally vertically disposed second body member positioned at said discharge end of said first body member with said second body member having upper and lower ends;

said second body member having a cylindrical chamber formed therein which has an inlet end and a discharge end;

said second body member having an annular valve seat provided in said chamber above its said inlet end;

said valve seat having an inlet side and a discharge side;

said inlet side of said valve seat being in communication with said first passageway;

said discharge side of said valve seat being in communication with said chamber;

a vertically movable first valve means selectively vertically movably mounted in said chamber;

said first valve means including a valve member positioned below said valve seat and a valve stem secured to valve member which extends upwardly therefrom through said valve seat and said chamber;

said first valve means being selectively vertically movable between a lower position to an upper position;

said valve member of said first valve means closing said valve seat when said first valve means is in its said upper position;

said valve member when said first valve means is in its said lower position, permitting the flow of water from said first passageway, through said valve seat, and upwardly into said chamber;

a valve actuating lever pivotally secured to said first body portion which is operatively connected to the upper end of said valve stem;

said lever being pivotally movable from an upper "off" position wherein said first valve means is in its said upper position to a lower "on" position wherein said valve member is unseated from said valve seat;

said first body portion having a horizontally disposed second passageway formed therein which extends from said chamber, above said valve seat, towards said discharge end of said first body portion;

said first body portion having a third body member positioned at the downstream side of said second body member;

said third body member having a transversely extending cylindrical spool opening formed therein;

said third body member having a third passageway which extends from said cylindrical spool opening to said second passageway;

said third body portion having a fourth passageway extending from said spool opening towards said discharge end of said body member;

said third and fourth passageways being in alignment with each other;

a first spool valve selectively rotatably mounted in said cylindrical spool opening;

said first spool valve having a first passageway extending thereinto which has the same diameter as said third passageway of said third body member;

said first spool valve having a second passageway extending thereinto which is aligned with said first passageway of said first spool valve and which is in fluid communication therewith;

said second passageway of said first spool valve having a diameter which is less than the diameter of said first passageway of said first spool valve;

said first spool valve having a third passageway extending therethrough which is transversely disposed with respect to said first and second passageways of said first spool valve and which has a diameter greater than the diameter of said second passageway of said first spool valve;

said first spool valve being selectively rotatable to a first position so that said first passageway of said first spool valve is in fluid communication with said third passageway of said third body member and so that said second passageway of said first spool valve is in fluid communication with said fourth passageway of said third body member;

said first spool valve also being selectively rotatable to a second position so that said third passageway of said first spool valve extends between and fluidly communicates with said third and fourth passageways of said third body member;

said body member having a fifth passageway formed therein which extends downwardly from said fourth passageway of said third body member to said lower end of said second body portion so as to be in communication with the liquid in the liquid container;

a horizontally extending chamber provided in said second body portion which extends between said sides thereof and which intersects said fifth passageway;

a multi-position second spool valve selectively rotatably mounted in said chamber in said second body portion;

said multi-position second spool valve having at least first and second intersecting metering orifices of different diameters formed therein which may be selectively placed into communication with said fifth passageway;

said multi-position second spool valve also being selectively rotated so as to block the passage of liquid chemical therethrough so that the dispenser may dispense a water-only spray rinse;

the passage of water through said fourth passageway of said third body member to said discharge end of said body member, when said first valve means is in its said open position drawing liquid from the liquid container upwardly through said fifth passageway and through said second spool valve when one of the metering orifices thereof is in communication with said sixth passageway for mixing with the water passing through said fourth passageway of said third body member.

2. The dispenser of claim 1 wherein said rotatable spool valve in said second body portion has opposite ends and wherein a handle is secured to each end of said spool.

3. The dispenser of claim 1 wherein said body member includes an elongated discharge tube at its said discharge end, said fourth passageway extending through said discharge tube.

4. The dispenser of claim 1 wherein said valve member has upper and lower ends and wherein the water under pressure exerts pressure against the lower end of said valve member, when said first valve means is in its said upper position, to assist in maintaining said first valve means in its said upper position.

5. The dispenser of claim 1 wherein said valve member has upper and lower ends and wherein the water under pressure exerts pressure against the upper end of said valve member, when said first valve means is in its said lower position, to assist in maintaining said first valve means in its said lower position.

6. The dispenser of claim 4 wherein said valve member has upper and lower ends and wherein the water under pressure exerts pressure against the upper end of said valve member, when said first valve means is in its said lower position, to assist in maintaining said first valve means in its said lower position.

* * * * *